United States Patent [19]

Gohara

[11] Patent Number: 4,828,482

[45] Date of Patent: May 9, 1989

[54] A METHOD OF OPERATING A FLUID BED COMBUSTOR

[75] Inventor: Wadie F. Gohara, Barberton, Ohio

[73] Assignee: The Babcock & Wilcox Company, New Orleans, La.

[21] Appl. No.: 9,657

[22] Filed: Jan. 28, 1987

Related U.S. Application Data

[63] Continuation of Ser. No. 762,972, Aug. 6, 1985, abandoned.

[51] Int. Cl.[4] ..... F23D 21/00; F23C 11/02

[52] U.S. Cl. ..... 431/7; 422/142; 422/146; 431/170

[58] Field of Search ..... 422/146, 142; 431/7, 431/170; 432/15, 58; 34/10, 57 A

[56] References Cited

U.S. PATENT DOCUMENTS

| | | | |
|---|---|---|---|
| 2,327,746 | 8/1943 | Shultz | 422/191 |
| 2,556,301 | 6/1951 | Squires et al. | 422/191 |
| 3,905,336 | 9/1975 | Gumble et al. | 422/198 |
| 4,457,896 | 7/1984 | Kono | 422/142 |
| 4,476,816 | 8/1984 | Cannon et al. | 422/142 |

OTHER PUBLICATIONS

Dalu et al., "Pneumatically Controlled Multistage Fluidized Beds", *Fluidization,* Plenum Press, 1980, pp. 485–492.

*Primary Examiner*—Barry S. Richman
*Assistant Examiner*—Timothy M. McMahon
*Attorney, Agent, or Firm*—Robert J. Edwards; Michael L. Hoelter

[57] ABSTRACT

A fluid bed combustor comprising a generally rectangular housing defining a freeboard space. A plurality of vertically spaced and horizontally staggered beds are provided in the housing and extend inwardly into the space from a rear wall and from a front wall of the housing. A serpentine flue gas path is defined between the staggered beds. Each bed is supplied with combustion air and fluidizable fuel with the freeboard space of each bed including gases from that bed plus gases from all previous beds in the flue gas path. In this way an increased residence time is established without substantially increasing the dimensions of the combustor. A simplified recycle system can also be provided since materials from each bed cascade down into a lower bed so that all materials are eventually accumulated in the lowest beds from which they can be removed.

1 Claim, 2 Drawing Sheets

A METHOD OF OPERATING A FLUID BED COMBUSTOR

This application is a continuation of application Ser. No. 762,972 filed Aug. 6, 1985 now abandoned.

FIELD OF THE INVENTION

The present invention relates in general to fluid bed combustors, and in particular to a new and useful combustor which utilizes a plurality of beds, at least some of which are staggered with respect to each other within a housing of the combustor.

BACKGROUND OF THE INVENTION

In fluid bed combustors, a stream of gas flows upward through a dense bed of solid fuel particles with sufficient force to suspend and tumble these particles together, thereby giving the bed the appearance of a boiling fluid. These suspended solid particles, which often consist of a combination of coal and limestone, are burned so as to generate heat which is absorbed through adjacent tubing. The sulfur dioxide ($SO_2$) exhaust from the coal is captured before its release into the atmosphere by its reaction with the calcium oxide (CaO) given off by the limestone thereby forming calcium sulfate ($CaSO_4$), a dry solid. A substantial amount of this chemical reaction or sulfur capture occurs while these exhaust gases mix in the freeboard area of the combustor above the fluid bed, and the completion of this freeboard reaction is directly related to the residence time of the gases in the combustor. If the exhaust gases are vented too quickly, or are vented without sufficient mixing, the amount of sulfur dioxide captured will be significantly reduced which generally results in unacceptably high levels of sulfur discharge.

Currently, the gas retention time within fluid bed combustors is increased by stacking fluid beds either vertically as shown in U.S. Pat. Nos. 3,905,336 and 4,135,885, or side-by-side or horizontally as shown in U.S. Pat. No. 3,893,426. These combustors are all of the atmospheric combustion type because combustion takes place at or near atmospheric pressure. In contrast, a pressurized fluidized bed combustor is shown in U.S. Pat. No. 3,863,606 in which combustion occurs at a pressure of several atmospheres.

Generally, stacked fluid beds are constructed in a parallel arrangement such that the flue gases from one bed do not flow around another bed but instead are separately channeled to the convection pass adjacent the combustion chamber and furnace shaft before being exhausted. This reduces the completion of the chemical reaction by reducing the gas retention time within the combustor. Thus, in existing fluid bed designes, thorough mixing of the gases in the freeboard area has been challenged because complete mixing of the flue gases from all the beds does not occur until these gases have reached the convection pass by which time the temperature of these gases has decreased below the optimum reaction temperature window which inhibits further reactions.

Additionally, the amount of limestone required for adequate sulfur capture, identified as the Ca/S ratio, is dependent upon the fuel sulphur content and the degree of limestone utilization achieved. Ideally, for a low, efficient Ca/S ratio, the calcined limestone in each of the beds should be consumed as completely as possible with any remaining unreacted lime being recycled for further consumption. A desirable way to decrease the Ca/S ratio is to increase the freeboard gas retention time which will thereby improve the overbed combustion efficiency and increase calcium utilization.

It is thus an object of this invention to provide an improved fluid bed combustor having a prolonged flue gas path thereby increasing the gas retention time in the combustor. Another object of this invention is to provide a combustor which increases the mixing of the flue gases and which promotes the completion of the sulfur capturing reaction by having a cumulative serpentine flue gas path within the combustor itself. It is a further object of this invention to provide a system of recycling spent fuel which enables the complete combustion of the fuel to occur thereby lowering the Ca/S ratio. These and other object and advantages of this invention are described in detail as follows:

SUMMARY OF THE INVENTION

The present invention is drawn to a fluid bed combustor which utilizes a serpentine path through the combustor housing. A plurality of fluid beds are stacked in a staggered relationship with at least two of the beds being vertically spaced from each other and at least two of the beds being horizontally spaced from each other thereby defining a cumulative serpentine flow path of the flue gases. Combustion gas means and fuel supply means are connected to each of the beds for supplying the combustion gas and fuel respectively to each bed in the combustor. The staggered arrangement of the fluid beds enables the overflow of the fluidized material in an upper bed to cascade or fall into the next lower bed, and so on until the overflow reaches the lowest bed by which time the consumption of this material has been either enhanced or completed.

DESCRIPTION OF THE PREFERRED EMBODIMENT

Figure 1:
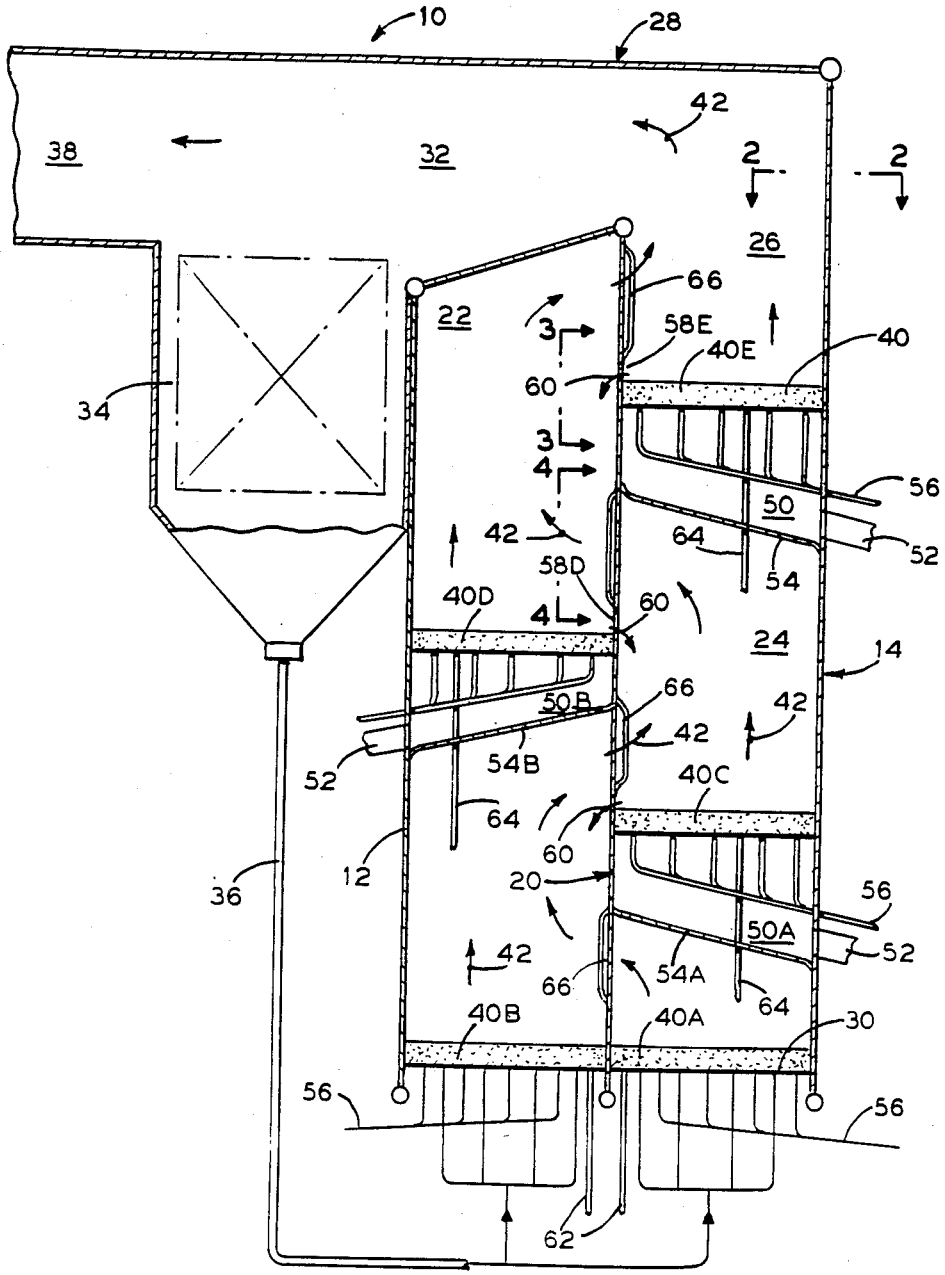
FIG. 1 is a diagrammatic vertical section of the fluid bed combustor.
Figure 2:
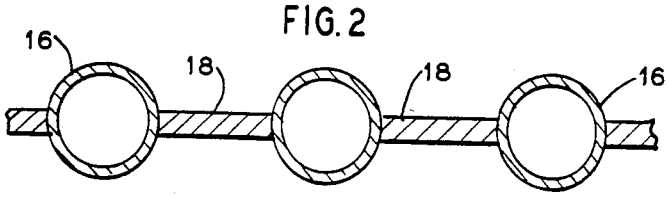
FIG. 2 is a pictorial view, partially broken away, of the membrane wall taken along lines 2—2 of FIG. 1.

Referring initially to FIG. 1, fluid bed combustor 10 is shown as being generally rectangular in shape, having front wall 12, back wall 14, and side walls (not shown). These walls are of membrane wall construction (FIG. 2) which consists of series of hollow, generally vertical tubes 16, secured longitudinally together by membranes 18. A fluid to be heated by combustor 10 flows through tubes 16 and is transported elsewhere, after heating, for utilization. Divide wall 20 in combustor 10 is also of membrane wall construction and it divides combustor 10 into two separate chambers, front chamber 22 and back chamber 24. The combination of chambers 22 and 24 comprise the freeboard area 26 of combustor 10. Top and bottom plates 28 and 30 respectively of combustor 10 complete the enclosure of freeboard area 26. Convection pass 32 adjacent top plate 28 provides a discharge opening for the flue gases from combustor 10 and these gases travel to dust collector 34 where the solid particles carried by these gases are collected and are recycled via recycle tubes 36 to the bottom of combustor 10 while the cleaned flue gases are conveyed through opening 38 for discharge elsewhere.

A series of fluid beds 40 are secured in a staggered relationship within combustor 10, with fluid beds **40*a* and 40*b* being supported on the bottom of chambers 24 and 22 respectively. Fluid bed 40*c* is secured above bed 40*a* in chamber 24 and fluid bed 40*d* is secured above bed 40*b* in chamber 22. Furthermore, as shown, fluid bed 40e is secured in chamber 24 but vertically spaced above bed 40*c*. Additional beds 40 may be secured within freeboard area 26 following this stacked and staggered arrangement, or, if desired, fewer beds 40 may be so arranged. Each of beds 40 extend fully across their respective chamber and are supported by divide wall 20 and also either front wall 12 or back wall 14 as the case may be. By this arrangement, the exhaust flue gases emanating from fluid beds 40 follow a serpentine path upward through combustor 10, thus the flue gases from upstream beds 40 are channeled systematically across downstream beds 40 as shown by arrows 42 before being exhausted through convection pass 32**.

Figure 3:
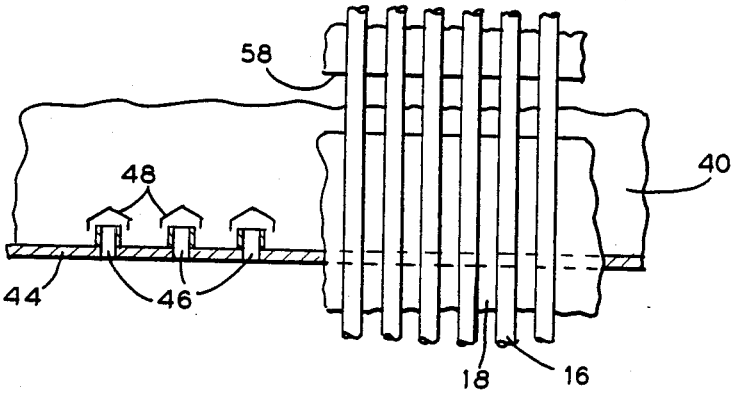
FIG. 3 is a pictorial view, partially broken away, of a typical overflow opening taken along lines 3—3 of FIG. 1.

Referring now also to FIG. 3, each fluid bed 40 includes an air distribution plate 44 which has a series of openings 46 therein for combustion gas to pass. Bubble caps 48 are secured directly above each opening 46 and these bubble caps enable combustion gas to flow upward through openings 46 while at the same time prevent any material supported on plate 44 from falling or passing downward through openings 46. Combustion gas is supplied to openings 46 in each bed 40 via windbox 50 through inlet openings 52 in walls 12 and 14. This combustion gas is slightly pressurized by means not shown, before being transported through windbox 50, inlet openings 52, and bubble caps 48 so as to lift and tumble the fuel supported on air distribution plate 44. Each of the elevated windboxes 50 has a sloped water cooled bottom 54 which acts as a baffle in their respective chamber of freeboard area 26 thereby deflecting and channeling any rising flue gases from a lower bed across divide wall 20 and into adjacent chamber 22 or 24 of combustor 10.

A fuel-bed material mixture of coal and limestone (or other inert solid as the bed material such as sand, $C_a$ $SO_4$, etc.) is supported on air distribution plate 44 and this mixture is fed into fluid beds 40 via supply tubes 56. During operation, this mixture is suspended above air distribution plate 44 via the pressurized combustion gas flowing through openings 52 and bubble caps 48. In its non-suspended state, however, this mixture has a depth of approximately two feet and consists of approximately 5% to upwards of 33% or more limestone depending on the sulfur content of the coal or fuel and the purpose of the combustor. Calciners and reactors require a high bed material to coal ratio while combustors require a high coal to bed material ratio.

The level of this mixture in each bed 40 while being suspended and burned is maintained by continuously supplying new material as that being burned is consumed or recycled. Pressurized combustion gas from windbox 50 suspends this mixture above air distribution plate 44 and tumbles the individual particles resulting in a highly turbulent mixing of the particles which gives the outward appearance of a boiling fluid.

Periodically, as the coal and calcined limestone particles are tumbled by the combustion gas, individual particles will fall through overflow openings 58 (FIG. 3) in membrane 18 of divide wall 20 and down onto a lower bed 40. These particles may be the residue from consumed coal or limestone particles, nonconsumed coal or calcined limestone particles, or a sulfate compound which captured sulfur from previously consumed coal. Overflow openings 58 in divide wall 20 are sized to a minimum of 3.5 diameters of the largest particle size in the bed and are located at an elevation of about four feet above its respective air distribution plate 44. This elevation is approximately that of the suspended fuel-bed material mixture in each bed 40. Thus, for example, a particle in bed **40*e* may fall through overflow opening 58*e* in divide wall 20 and onto bed 40*d* as shown by arrows 60. This same particle, or another particle from bed 40*d* may then cascade through overflow opening 58*d* onto bed 4*c* which in turn spills its overflow onto bed 40*b* in chamber 22**.

The constant tumbling of the fuel and the continuous supply of new fuel into beds 40 causes these particles to overflow from a higher bed 40 into the next lower bed 40. These overflow particles which collect in lower beds **40*a* and 40*b* are then transported elsewhere via tubes 62 for recycling and/or disposal. The usable recycled material is redelivered to beds 40 via supply tube 56** enabling this material to become fully consumed.

As an alternative to the above described cascading overflow system, a series of overflow pipes 64 may be attached to each bed 40 and the overflow particles, instead of cascading into a lower bed 40 through overflow openings 58 in divide wall 20, will overflow into a lower bed 40 through pipes 64. As shown in FIG. 1, these pipes 64 discharge overflow particles into beds 40 directly underneath the overflowing bed with the end result being the eventual accumulation of the overflow particles in lower beds **40*a* and 40*b*. This overflow is then transported elsewhere for recycling with the recyclable material being re-introduced into fluid beds 40 via supply tubes 56**.

During operation, combustion gas is pressurized sufficiently enough to suspend the bed material particles in beds 40 with the desired degree of tumbling and mixing. This mixture is heated until their combustion is self-supporting and as the mixture is consumed, a new supply of fuel is fed through supply tubes 56. The flue gas emitted from each bed 40 by the combustion of this mixture travels upward through freeboard area 26 resulting in these gases mixing more thoroughly. As previously stated the calcium oxide given off from the limestone and the sulfur dioxide given off from the coal combine in the freeboard area above each bed to form calcium sulfate, a solid, which is drained from in beds **40*a* or 40*b*** for subsequent recycling and/or disposal.

Figure 4:
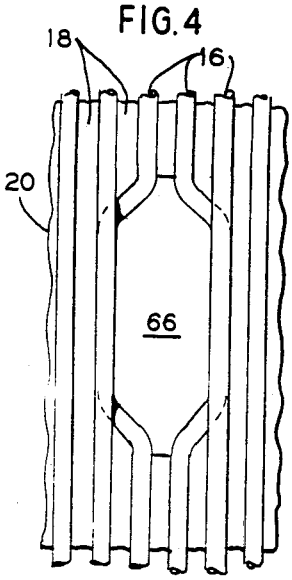
FIG. 4 is a pictorial view, partially broken away, of a typical flue gas opening, taken along lines 4—4 of FIG. 1.

To better illustrate the flue gas path through combustor 10, the flue gas emitted from bed 40a will be more fully described. The uncombined flue gases from bed **40*a* travel upward until being diverted by sloped water cooled bottom 54*a* of windbox 50*a* directly above bed 40*a*. This water cooled bottom 54*a* directs the flue gases through flue gas opening 66 in divide wall 20 (FIG. 4) and into chamber 22. Flue gas openings 66 consist of a plurality of tubes 16 of divide wall 20 essentially bent out of the normal plane of divide wall 20 thereby enabling the flue gases to travel through this section of divide wall 20 as shown by arrows 42. These flue gases from bed 40*a*, by passing through flue gas opening 66** and into chamber 22, cause turbulance thereby promoting the mixing of the exhaust gases from bed 40*b* which increases the sulfur capture in this combined exhaust. Still traveling upward, the combined exhaust from beds 40*a* and 40*b* are baffled by sloped bottom 54*b* of windbox 50*b* directly above bed 40*b*. This water cooled bottom diverts the combined gases through adjacent flue gas opening 66 and into chamber 24 above bed 40*c*. These gases pass around bed 40*c* (as the gases passed around beds 40*a* and 40*b*), mix, and combine with the exhaust gases from bed 40*c* similar to the manner in which the exhaust gases from beds 40*a* and 40*b* were combined. Again sulfur capture is enhanced. This serpentine path of the exhaust gases through flue gas opening 66 and across stacked beds 40*c*, 40*d*, and 40*e* continues through freeboard area 26 around each of the elevated beds 40 until being discharged via convection pass 32 from combustor 10.

This serpentine path promotes further mixing of the gas to encourage more of the sulfur to be captured in combustor 10. As the sulfur is captured as calcium sulphate, it is collected in each of beds 40 and tumbled with the coal and limestone mixture until being discharged out the bed via overflow opening 58. This overflow process continues until the particles subsequently reach lower beds 40 and are disposed of. Particles escaping combustor 10 and passing through convection pass 32 are collected by dust collector 34 and recycled to beds 40*a* and 40*b* via recycle tubes 36.

Figure 5:
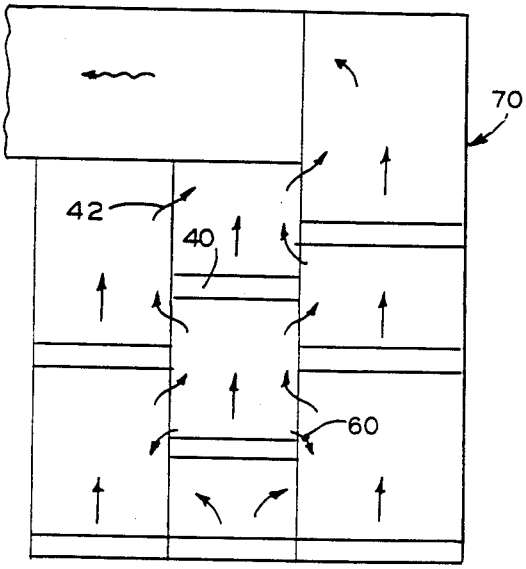
FIG. 5 is a diagrammatic vertical section of an alternate configuration of a fluid bed combustor.

Referring now to FIG. 5, there is shown an alternate configuration of a fluid bed combustor. This combustor 70 is similar in construction and operation to combustor 10 but combustor 70 includes an additional section of stacked and staggered beds 40. In combustor 70 the exhaust gas path is even more broken up thereby significantly increasing the gas retention time in combustor 70 and improving the sulfur capture from the flue gases.

In both combustors 10 and 70, the exhaust flue gases from one bed 40 combined with the gases emitted from and flowing across preceeding beds 40, thus these gases may be said to combine cumulatively or flow in series, and these gases are not isolated from the gases generated by adjacent beds. This serpentine or broken path serves to increase the gas retention time over that of a regular combustor by upwards of 150 percent, thereby enabling more calcium utilization and greater sulfur capture resulting in a lower, more efficient Ca/S ratio than is normally achievable. Further the cascading overflow system described eliminates the need for a large and complex overflow transportation and metering system. All the overflow material collected in combustors 10 or 70 are removed from the lower beds 40. In addition, the utilization of freeboard area 26 as now described enables thorough gas mixing and a uniform and vertical temperature profile across this freeboard area. Finally, it is noted that although an under bed coal and limestone supply system is disclosed, an overbed supply system is equally possible.

While specific embodiments of the invention have been shown and described in detail to illustrate the application of the principals of the invention, it will be understood that the invention may be embodied otherwise without departing from such principals.

What is claimed is:

1. A method of operating a fluid bed combustor comprising the steps of:

a. vertically staggering a plurality of fluid beds on opposite sides of a divide wall, each said fluid bed comprising a combustion bed from which flue gases emerge and a freeboard space immediately above each said combustion bed for the passage of said flue gases thereinto;

b. transferring said flue gases through openings in said divide wall from one said freeboard space directly into an adjacent and more elevated freeboard space;

c. accumulating and mixing in each said freeboard space said flue gases emitted from each upstream combustion bed, said upstream flue gases passing around and over the top of each downstream combustion bed;

d. altering the direction of flue gas exiting a said freeboard space with respect to its direction entering the same said freeboard space by approximately 180°;

e. whereby the accumulating and mixing of said flue gases as they pass through the combustor provide a generally uniform temperature throughout said freeboard spaces.

* * * * *